US005100112A

United States Patent [19]

Wörner

[11] Patent Number: 5,100,112

[45] Date of Patent: Mar. 31, 1992

[54] VERTICAL-SHAFT FURNACE FOR THE HEAT-TREATMENT OF METALLIC WORKPIECES

[75] Inventor: Theo Wörner, Waiblingen-Neustadt, Fed. Rep. of Germany

[73] Assignee: Aichelin GmbH, Munchingen, Fed. Rep. of Germany

[21] Appl. No.: 599,143

[22] Filed: Oct. 17, 1990

[51] Int. Cl.[5] ..... C21B 1/00

[52] U.S. Cl. ..... 266/249; 266/253

[58] Field of Search ..... 266/249, 253

[56] References Cited

U.S. PATENT DOCUMENTS 2,263,029 11/1941 Buckner ..... 266/253

OTHER PUBLICATIONS

"Aichelin Industrial Furnaces, Vertical Furnaces Type V, W 12, A/GB (of the year 1983)".

*Primary Examiner*—Peter D. Rosenberg

*Attorney, Agent, or Firm*—Kokjer, Kirchner, Bowman & Johnson

[57] ABSTRACT

A vertical-shaft furnace serves for heat-treating metallic workpieces. It comprises a furnace housing with a heating chamber arranged therein. The heating chamber is provided with a closed wall at its upper end, while its lower end can be opened in order to enable the workpieces, which are to be treated, to be loaded into the heating chamber from below. There are further provided heating means for heating the heating chamber, means for lifting a workpiece carrier from a first lower position below the lower end of the heating chamber into a second upper position inside the heating chamber, the workpiece carrier being suspended on at least one flexible element which is passed through the opening in the upper wall of the heating chamber and connected to a drive outside the heating chamber. The flexible element is provided with a rod-shaped section which in the second upper position of the workpiece carrier extends through the opening and is embraced in this second position by a sealing element in gas-tight relationship. A wall projecting from the sealing element in downward direction surrounds the opening in the upper wall of the heating chamber, which latter is immersed to float in a liquid contained in a double-walled vessel with open top which surrounds the opening in the upper wall of the heating chamber and is firmly connected to that wall at the upper end of the heating chamber.

13 Claims, 5 Drawing Sheets

VERTICAL-SHAFT FURNACE FOR THE HEAT-TREATMENT OF METALLIC WORKPIECES

BACKGROUND AND SUMMARY OF THE INVENTION

The present invention relates to a vertical-shaft furnace for the heat-treatment of metallic workpieces having a furnace housing with a heating chamber arranged therein, the heating chamber being provided with a closed wall at its upper end, while its lower end can be opened in order to enable the workpieces, which are to be treated, to be loaded into the heating chamber from below.

The term heat-treatment is used, in connection with metallic workpieces, to describe a process by which the workpieces are subjected, for improvement of their mechanical properties, to the effect of a high temperature, the temperatures employed being in the range of up to 1,000° Centigrade, whereafter the workpieces are cooled down again.

If oxidation of the workpieces through the oxygen contained in the air is to be avoided, heat-treatment is performed in a protective-gas atmosphere, mostly a mixture of an inert gas such as nitrogen, and hydrogen.

The heat-treatment processes, which have become known as "tempering" and "bright annealing", include the steps of heating up the metallic workpieces and, if hardening is desired, cooling them down thereafter very rapidly in a quenching bath. The term heat-treatment further covers thermo-chemical processes where the marginal layers of the metallic materials undergo a chemical change. Such thermo-chemical treatments have been known as carburization, nitriding and nitrocarburization, respectively. The carburization process leads to the accumulation of carbon in the marginal layers of the metallic materials. The nitriding process leads to an accumulation of nitrogen in the marginal layers, and the nitro-carburization process leads to an accumulation of both, nitrogen and carbon, in the marginal layers.

In the case of vertical-shaft furnaces, the workpieces to be treated are loaded into the heating chamber in vertical direction, whereafter the heating chamber is closed gas-tight for the purpose of carrying the heat-treatment process in the heating chamber.

If very big and very heavy metallic workpieces are to be heat-treated, for example a cylindrical metallic housing of a rocket stage, having for example a height of approx. 20 m, a diameter of approx. 5 m and a weight of approx. 10 tons, there must be provided correspondingly powerful and strong means for loading such a workpiece into, and unloading it from, the heating chamber.

Another problem resides in the fact, that the lifting and lowering means employed for loading the workpiece into, and unloading it from, the vertical-shaft furnace must not remain in the heating chamber during the heat-treating process; otherwise, they would have to be heated up, too, during each heat-treating process, which would be a considerable waste of energy, and in addition they would be exposed to constant temperature changes if employed in continuous operation, which would reduce their service life. If used for thermo-chemical treatments, the means for lifting and lowering would become unserviceable after a certain number of treatments as the moving parts, in particular, would undergo heavy changes in structure due to the processing alteration of their marginal layers.

There have been known vertical-shaft furnaces which are provided with a removable lid at their upper end. When workpieces are to be loaded into the vertical-shaft furnace, the lid is opened and moved laterally clear of the opening, and the workpieces are loaded into the vertical-shaft furnace from the top, using a hoist, the furnace being in this case is closed at the bottom. Once the hoist has been removed from the vertical-shaft furnace, the lid is closed gas-tight, and the heat-treatment is carried out in the heating chamber. For removing the workpieces after completion of the heat-treatment, the lid must be opened, the hoist must be lowered into the furnace, and the workpiece, or a workpiece carrier on which the workpiece is mounted, must be picked up. If the workpieces are to be dipped into a quenching bath, the hot glowing workpieces must be lifted off the vertical-shaft oven, transported in lateral direction and then immersed into the quenching bath. This procedure is time-consuming and complicated, and in addition the workpiece gets into contact with the open air during transfer to the bath, so that oxidation processes may occur on the hot, heat-treated workpiece during such transfer, which processes may later lead to the formation of cracks and make the workpiece unserviceable. In the case of a workpiece intended to be used as a rocket stage housing, such circumstances might have fatal consequences. During the time-consuming transfer of the hot, bulky and heavy workpieces from the vertical-shaft furnace to the quenching bath, the hot workpieces may in addition start to cool partially, and this may lead to warping of the workpiece.

In the case of very big workpieces, it is an additional problem that these workpieces must be introduced into the quenching bath very rapidly in order to prevent distortions.

If, for example, a hollow-cylindrical metallic body having a height of approx. 20 m is to be introduced into a quenching bath with the cylinder axis in upright position, and if the immersion process is carried out slowly, then the portion immersed at any time in the bath will cool down rapidly already when a big portion of the body is still outside of the quenching bath and presents a considerably higher temperature. In such a case, considerable warping will be encountered.

There is further the possibility to design a heating chamber of a vertical-shaft furnace in such a way that the upper end of the heat chamber is closed by a wall, while the lower end of the heating chamber can be opened for loading the workpiece carrier with the workpieces mounted thereon into, and unloading it from, the heating chamber. The bottom of such a furnace may then be detachable or may swing to the side. If the workpieces or the workpiece carrier are to be suspended in the cavity of the heating chamber, and if the driving means are to be arranged outside the heating chamber, as mentioned before, it will be necessary to pass some mounting elements, such as rods, ropes or chains, on which the workpieces or the workpiece carrier are to be suspended, through the closed upper wall of the heating chamber. The passage must be gas-tight in order to prevent the protective gases from escaping from the heating chamber and/or oxygen contained in the air from entering the chamber, through the openings in the upper wall, during the heat-treatment process.

Another problem resides in the fact that the elements, on which the workpiece carrier is suspended and which are passed through the openings in the closed upper wall, will move past the sealing means very rapidly as the workpiece is being lowered—in the required rapid manner—from the heating chamber into a quenching bath arranged below the latter, so that the sealing means will be subjected to extremely high mechanical stresses.

A further problem is seen in the fact that the elements which are passed through the upper closed wall of the heating chamber and which carry the workpieces in the cavity of the heating chamber, are of course also heated during heating-up of the workpieces, and will then expand correspondingly. With temperature differences between room temperature and almost 1,000° Centigrade, the hoists used for carrying workpieces weighing in the range of 10 tons must be provided with amply sized suspension elements for the workpieces, a fact which results in relatively big expansion values during heating-up of the workpieces.

Consequently, it is extremely difficult, and connected with many problems, to realize a permanently gas-tight connection between the opening in the upper wall of the heating chamber and the element passed therethrough, over such an important temperature range.

Special problems are encountered when open-link chains, consisting of oval links nested in each other so that they are turned alternatively by 90° along the chain axis, have to be passed through the opening in the upper wall as such open-link chains do not present a uniform profile about their circumference.

It is, therefore, a first object of the invention to provide a vertical-shaft furnace which enables elements, in particular open-link chains on which workpieces are suspended, to be passed through the upper closed wall of the heating chamber in gas-tight relationship, and where this gas-tight passage will be maintained even if the elements should move in horizontal and/or vertical directions due to expansion phenomena.

The invention has further for its object to provide a vertical-shaft furnace which is easy to handle and can be operated fully automatically.

According to the invention, a vertical-shaft furnace for the heat-treatment of metallic workpieces is equipped with means for lifting a workpiece carrier from a first lower position below the lower end of the heating chamber into a second upper position inside the heating chamber, wherein the workpiece carrier is suspended on at least one flexible element which is passed through the opening in the upper wall of the heating chamber and connected to a drive outside the heating chamber, wherein the flexible element is provided with a rod-shaped section which in the second upper position of the workpiece carrier extends through the opening and is embraced in this second position by a sealing element in gas-tight relationship, wherein a wall projecting from the sealing element in downward direction surrounds the opening in the upper wall of the heating chamber, and wherein the projecting wall is immersed to float in a liquid contained in a double-walled vessel with open top which surrounds the opening in the upper wall of the heating chamber and is firmly connected to that wall at the upper end of the heating chamber.

The sealing element acts as direct gas-right seal about the circumference of the flexible element. By designing the flexible element in such a way that a rod-shaped section of the flexible element which exhibits a uniform geometry about its periphery over a certain part of its length, will occupy a position in the area of the opening when the workpiece carrier in its second upper position, it is now possible to seal the circumference of this rod-shaped area in a simple manner using conventional sealing means. Sealing is rendered particularly easy when the rod-shaped area is given a circular cross-section.

Consequently, the flexible element can be given the design of an open-link chain comprising a rod-shaped section which extends through the opening in the upper wall of the heating chamber when the workpiece carrier occupies its second, raised position. The gasket of the sealing element surrounding the rod-shaped section of the chain is then adapted to the geometry of the circumference of the rod-shaped section, to fit closely to the latter.

The floating arrangement of the wall, which projects downwardly from the sealing element, in the double-walled vessel surrounding the opening provides a gas-tight connection between the bottom face of the sealing element and the vessel surrounding the opening in the upper wall. At the same time, this arrangement makes it possible for the floating wall to move to a certain degree in horizontal direction inside the double-walled vessel. In addition, the wall is permitted to move to a certain degree in vertical direction, i.e. by exactly the length by which the wall is immersed in the liquid. This makes it possible to balance out possible variations in the position of the rod-like section of the flexible element extending through the opening, in both the horizontal and the vertical direction, by permitting the sealing element which fits tightly around the rod, or rather the wall extending downwardly therefrom, to "float" in the double-walled container in vertical and/or horizontal direction, while the gas-tight seal is permanently maintained.

The relative position between the rod-shaped section of the flexible element and the sealing element surrounding it in gas-tight relationship does not change during such movements. The projecting wall of the sealing element, which is permitted to float in the vessel, provides a gas-tight barrier between the sealing element and the outside and is capable of balancing out any positional changes between the rod-shaped sections and the opening in the wall of the heating chamber over the length by which the projecting wall of the sealing element is immersed in the liquid of the vessel, or the amount which it is permitted to move to and fro in the vessel in the horizontal direction.

Positional changes between the rod-shaped section of the flexible element and the opening in the upper wall of the heating chamber may be due, for example, to thermal expansion phenomena encountered during the heating-up phase, the expansion of the flexible element, with the workpiece suspended thereon, having a vertical and a horizontal component.

Positional changes in the horizontal position may result also when different heat-treatment processes are carried out on workpieces of different weights which may result in a greater or lesser longitudinal expansion of the flexible element, depending on the particular weight. Such longitudinal expansion may also be compensated by a vertical movement of the wall of the sealing element, which is immersed in the liquid, without any interruption of the gas-tight condition. There is then no need for compensating these positional changes by a complex control arrangement for the drive, which would require the determination of the weight of each workpiece being processed. The length of the wall in the axial direction, or the depth of immersion in the liquid, must of course be selected in a suitable way to accommodate any displacements that may be encountered in the vertical direction.

According to another embodiment of the invention, the sealing element is designed in the form of a disk provided with a central passage opening for the flexible element, and the rod-shaped section is followed, via a shoulder, by a section of a diameter larger than that of the passage opening, a gasket being arranged between the shoulder and the disk.

This feature provides the advantage that sealing between the sealing element and the rod-shaped section of the flexible element is achieved by very simply and sturdy constructional means. The flexible element is raised for this purpose until the shoulder abuts against the bottom face of the disc, thereby providing a gas-tight barrier, with the aid of the intermediate gasket. The flexible element, with the sealing element resting on its shoulder, may then be additionally raised a distance equal to the length by which the wall projecting from the bottom phase of the sealing element is immersed in the liquid. The drive of the flexible element may then be adjusted in such a way that in the unloaded condition of the flexible element, i.e. when no workpiece is suspended on it, the rod-shaped element, together with the sealing element resting on its shoulder, are raised just to a point where the wall projecting from the bottom face of the sealing element is still immersed in the liquid. Now, when a workpiece of greater or lesser weight is suspended on the flexible element, the latter is expanded by a corresponding amount (in addition to the expansion caused by the heat), the depth of the double-walled vessel and/or the length of the wall projecting from the bottom face of the sealing element being designed in such a way that the wall will continue to float in the liquid, even in the condition of maximum expansion. This guarantees at any time the gas-tight passage for the flexible element through the opening in the upper wall of the heating chamber.

According to another embodiment of the invention, the diameter of the opening in the upper closed wall of the heating chamber is such that the area of the rod-shaped section of the flexible element, which presents the largest diameter, is received in the opening at a certain lateral play.

This feature provides the advantage that even the area of greatest diameter of the flexible element will pass through the opening at a certain lateral distance from the wall surface defining the opening so that no contact will occur between the two parts during raising or lowering of the flexible element and any possible damage to the opening will be avoided. The diameter of the opening in the wall is considerably larger than that of the flexible element which extends upwardly through the passage opening in the sealing element so that, consequently, an even greater clearance remains between this portion of smaller diameter and the inner wall of the opening. It is thus possible, when lowering the workpieces from the second upper position, for example after completion of a heat-treatment process, to lower the flexible element very rapidly into the second lower position without there being any risk that the flexible element moving downward with great rapidity may damage the wall surrounding the opening. It is then also possible, for example, to pass very strong chains very rapidly through the opening in the upper wall of the heating chamber, without any risk that the wall surrounding the opening may get damaged by individual chain links getting into contact with the wall.

According to a further embodiment of the invention, the double-walled vessel surrounding the opening comprises a first inner wall encircling the opening and a second outer wall arranged at a certain distance from the said first wall, the distance between the first inner wall and the second outer wall being at least equal to the difference between the diameter of the opening in the upper wall of the heating chamber and the outer diameter of the thicker area of the rod-shaped section of the flexible element.

This feature provides the advantage that the wall projecting from the bottom face of the sealing element, viewed in the radial direction of the opening of the wall in the heating chamber, is permitted to float in the horizontal directions by a maximum amount equal to the maximum lateral play between the flexible element and the opening.

According to another embodiment of the invention, the first inner wall is arranged immediately adjacent the edge of the circular opening in the upper wall of the heating chamber, and the wall projecting downwardly from the sealing element into the liquid of the vessel presents a cylindrical shape and occupies a central position between the first inner wall and the second outer wall when the longitudinal center axis of the flexible element extends coaxially to the longitudinal center axis of the circular opening in the upper wall.

This feature provides the advantage to render possible a horizontal floating movement of the wall in the sealing element in any radial direction.

According to a further embodiment of the invention, the vessel containing the liquid, in which the wall projecting downwardly from the sealing element is immersed in floating relationship, is connected to a recirculating device for the liquid by at least one inlet and at least one outlet, the liquid being adjusted to a predetermined temperature in the recirculating device.

This feature provides the advantage that it is now possible, for example by cooling the liquid during the heat-treatment process in the heating chamber, to maintain the structural components in the area of the passage of the flexible element through the opening in the upper wall of the heating chamber at a constant temperature. This extends the service life of the structural components, the latter being no longer exposed to the high and varying temperatures prevailing inside the heating chamber.

According to another advantageous embodiment of the invention, three flexible elements in the form of chains are provided and arranged at the corners of an imaginary equilateral triangle, relative to the cross-section of the heating chamber, the chains being connected to a single driven shaft which extends in parallel to, and at a certain distance from, one of the sides of the triangle.

This feature provides the advantage that the suspension on three chains ensures tilt-free mounting of the workpiece, relative to its horizontal position. In order to tilt a workpiece carrier, which is suspended on three chains, out of a horizontal plane, at least one of the chains would first have to be relieved from its load, a circumstance which can be excluded in view of the high weight of the workpieces. On the other hand, if the workpiece were suspended on one chain, or on two chains, the workpiece could well tilt or swing out of the horizontal plane in the area where the workpiece carrier, or the workpiece itself, is connected to the lower end of the flexible element, and in the case of a single chain there would be an additional risk of the workpiece rotating about the vertical longitudinal axis of the flexible element. Any such rotation about the vertical axis is likewise excluded when the suspension is realized by three chains arranged at the corners of an imaginary triangle. This means, however, that the orientation of the chain ends mounted at these three points of the imaginary triangle remains the same in any lifting position so that coupling of the workpiece carrier, which is suspended on three chains, to a workpiece-carrier frame or to a workpiece can be effected fully automatically, without the need to have this process supervised by an operator who will interfere manually if it should become necessary to rotate the workpiece carrier into the correct position manually. Consequently, operation of the furnace is facilitated considerably by this arrangement.

Other advantages of the invention will appear from the following description.

It is understood that the features which have been described above or which will be explained further below, may be used not only in the described combinations, but in any other combination or individually, without leaving the scope of the present invention.

The invention will now be discussed and described in more detail by way of a selected embodiment of the invention, with reference to the attached drawings.

DETAILED DESCRIPTION OF THE INVENTION

Figure 1:
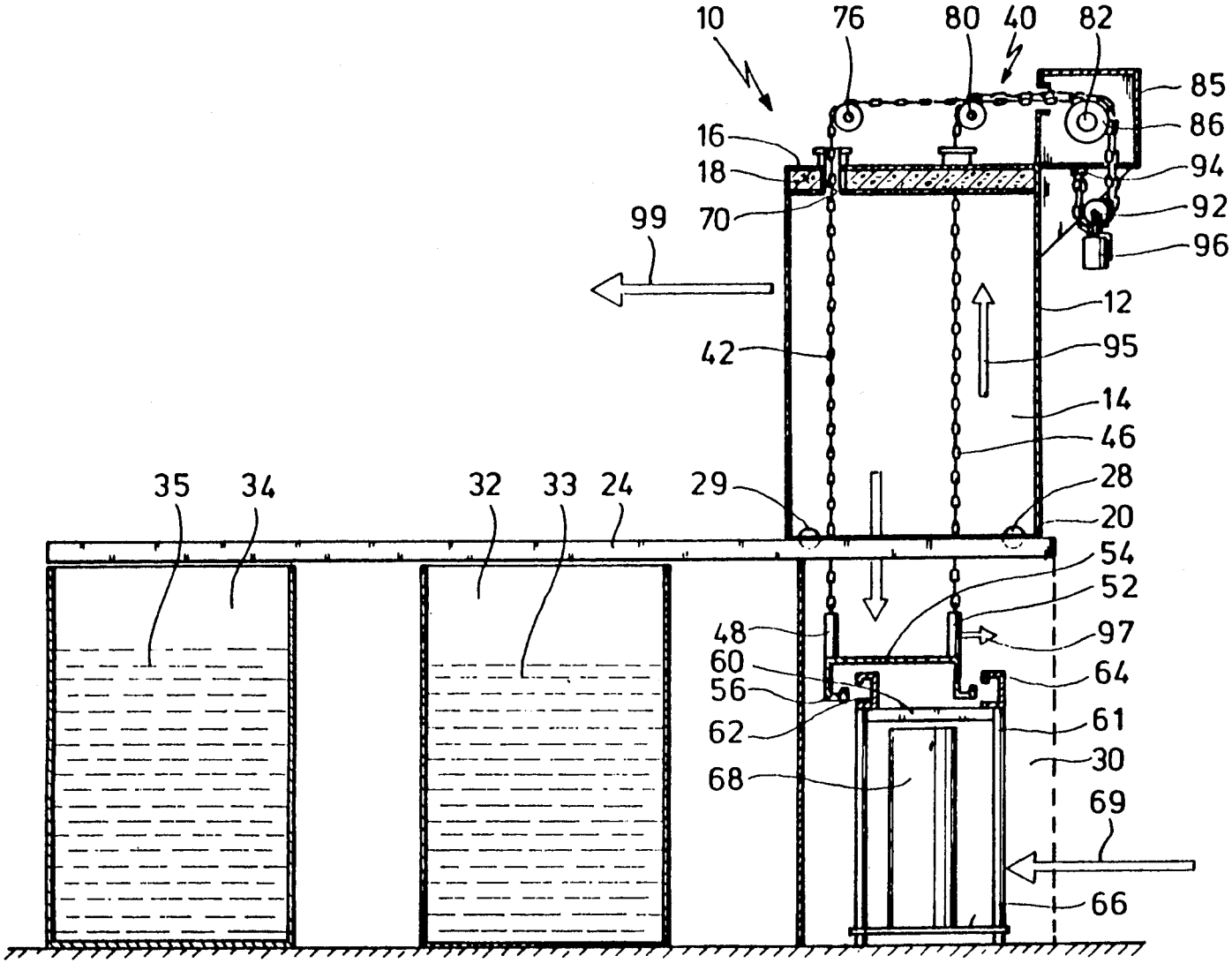
FIG. 1 is a very diagrammatic representation of a vertical longitudinal cross-section through the vertical-shaft furnace according to the invention, with the workpiece carrier occupying a first lower position, ready to accept a workpiece.
Figure 2:
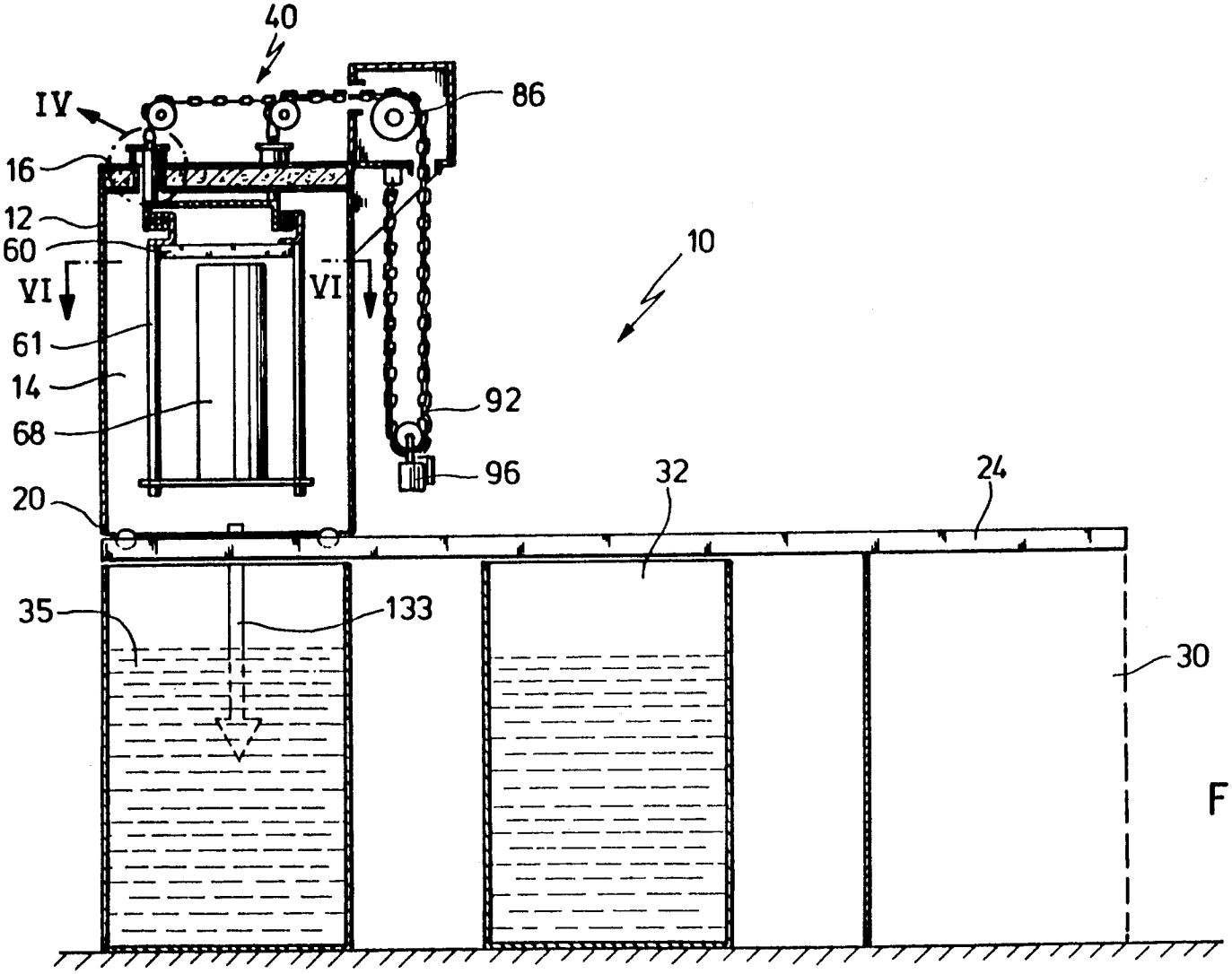
FIG. 2 shows a representation of a vertical-shaft furnace similar to that of FIG. 1, but in the operating condition in which a heat-treatment process is being carried out in the heating chamber of the furnace.

In FIGS. 1 and 2, a vertical-shaft furnace is indicated generally by reference numeral 10.

The vertical-shaft furnace 10 comprises a substantially cylindrical housing 12 enclosing a heating chamber 14.

The upper end 16 of the heating chamber 14 is closed by a horizontal wall 18.

The heating chamber 14 has an open lower end 20 which can be closed gas-tight by a bottom 20 mounted to swing laterally.

The heating chamber 14 is equipped with the usual heating elements which are, however, not shown in the drawing for the sake of clarity. In addition, the heating chamber 14 is connected to lines, likewise not shown in the drawing, through which an inert gas, for example a mixture of hydrogen and nitrogen, can be supplied into the heating chamber 14. Other, additional connections serve for supplying specific gases into the heating chamber 14, depending on the type of treatment being carried out at any time in the heating chamber 14. If a carburization process is to take place in the heating chamber 14, a gas containing carbon, such as carbon monoxide or a hydrocarbon, may be supplied into the chamber. For a nitriding process, in contrast, a gas containing nitrogen, mostly ammonia, will be supplied into the heating chamber 14. If a nitrocarburization process is to be carried out, the gas mixtures supplied into the chamber will be suitable for this process and will consist of gases containing carbon and nitrogen.

The housing 12 enclosing the heating chamber 14 rests on a frame 26 (see FIG. 3) arranged to travel on two horizontal rails 24, 25. The frame 26 is provided for this purpose with drive means not shown in the drawing. The frame 26 is supported on the rails 24, 25 via wheels 28, 29.

The rails 24, 25 extend across and above a loading and unloading station 30, a washing station 32 containing a washing bath 33, and a cooling station 34 containing an oil bath 35.

The housing 12 is provided with means 40 for lifting and raising the workpieces to be treated in the heating chamber 14.

The means 40 comprise three chains 42, 44, 46, all designed as metallic open-link chains.

Each of the chains 42, 44, 46 has its lower free end connected to a rod 48, 50, 52. Each of the rods 48, 50, 52 consists of a metallic round bar which will be described in more detail further below, with reference to FIG. 4.

Each rod 48, 50, 52 is connected at its lower end, i.e. the end opposite the one which is connected to the respective chain 42, 44, 46, to a workpiece carrier 54. The lower free ends of the chains 42, 44, 46 and/or the rods 48, 50, 52 are all located in one horizontal plane which means that the workpiece carrier 54 extends in a horizontal plane. Viewed from the top, the workpiece carrier 54 has the shape of an equilateral triangle and is fixed on the rods 48, 50, 52 at the corners of the triangle.

The lower face of the workpiece carrier 54 is provided with grippers 56, 58 which extend downwardly from the corners of the triangle and which exhibit the form of forks having their prongs all pointing in the same direction.

The workpiece carrier 54 serves for gripping a workpiece carrier frame 60. As can be seen best in FIG. 6, the workpiece carrier frame 60 has the cross-sectional shape of an equilateral triangle. The upper end of the workpiece carrier frame 60 is provided, at each of the corners of the described triangle, with a hook 62, 64, the latter being all directed to one side, i.e. in the direction of the forks of the grippers 56, 58 of the workpiece carrier 54.

The workpiece carrier frame 60 comprises a bottom 66 which is connected, via vertical supports 61, 61', 61'', to the upper end of the workpiece carrier frame 60 which carries the hooks 62, 64.

A workpiece 48 placed on the bottom 66 of the workpiece carrier frame 60 has the shape of a metallic pipe having a height of approx. 20 m and a diameter of approx. 5 m. The workpiece 68, which is a component of a drive rocket for a spacecraft, is to be subjected in the heating chamber 14 to a thermo-chemical heat-treatment process which is intended to approve its mechanical properties.

The chains 42, 44, 46 are passed to the outside through the openings 70, 72, 74 in the wall 18 closing the heating chamber 14 at its upper end.

Figure 3:
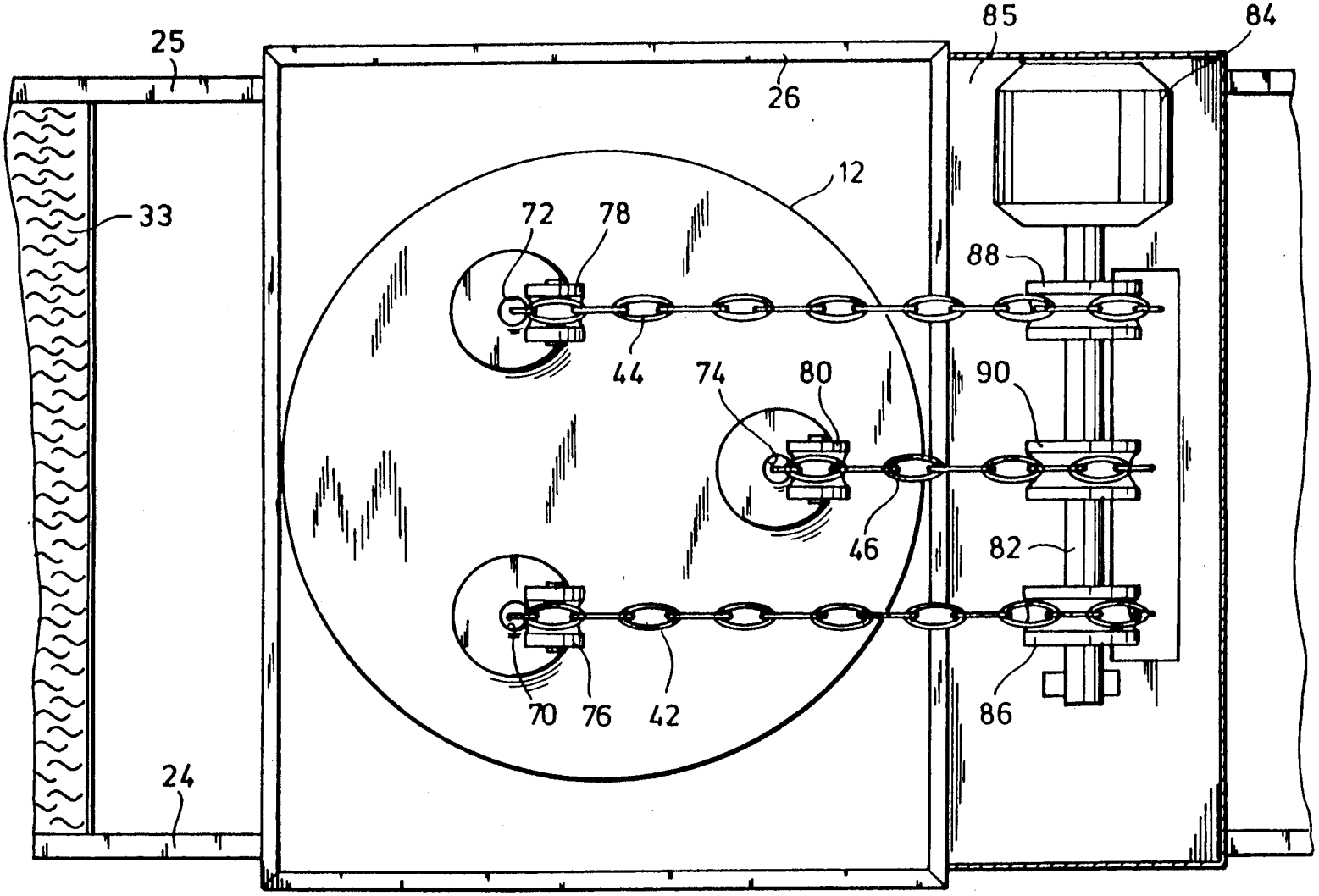
FIG. 3 shows a partial top view, in greatly enlarged scale, of the housing of the vertical-shaft furnace according to FIG. 1.

As can be seen best in FIG. 3, the openings 70, 72, 74 are arranged at the corners of an imaginary equilateral triangle formed by imaginary lines connecting the free openings.

Each of the three chains 42, 44, 46 is run over a pulley 76, 78, 80, after it has passed its respective opening 70, 72, 74, and from there in horizontal direction to a pulley 86, 88, 90, which latter are all carried on a shaft 82.

The shaft 82 extends in parallel to an imaginary connection line between the openings 70 and 72.

One end of the shaft 82 is connected to a drive motor 84, while its other end is supported in a bearing not shown in the drawing.

The pulleys 86, 88, 90 have all the same outer diameter so that when the shaft 82 is rotated by the drive motor 84 the three chains 42, 44, 46 are all displaced by the same length.

Having passed the pulleys 86, 88, 90 each of the chains 40, 44, 46 runs over a loose pulley 92, . . . and is then returned to a lug 94, . . . provided at the bottom of a mounting arrangement 85.

The loose pulley 92 carries a counter-weight 96.

While FIGS. 1 and 2 show only the loose pulley 92 about which the chain 42 is run, the pulleys for the chains 44 and 46 are arranged directly behind the pulley 92.

As regards the further structural components, in particular the exact design of the vertical-shaft furnace in the area of the openings 70, 72, 74, these will be described hereafter in connection with the discussion of the operation of the vertical-shaft furnace 10, with reference to the figures.

The illustration of FIG. 1 shows a situation where a workpiece carrier frame 60 carrying a workpiece 68 has been positioned in the loading and unloading station 30. This may be effected, for example, by feeding the workpiece carrier frame 60 laterally into the loading and unloading station 30, as indicated by arrow 69.

In the illustrated condition, the housing 12 of the vertical-shaft furnace 10 occupies a position above the loading and unloading station 30, and the workpiece carrier 54 has been lowered, by operation of the drive motor 84, to a position where its grippers 56, 58 are located approximately at the level, but beside, the hooks 62, 64 of the workpiece carrier frame 60. The workpiece carrier 54 being suspended on the three chains 42, 44, 46, the alignment of the grippers 56, 58 illustrated in FIG. 1 is in fact predetermined so that no manipulations need to be carried out on the workpiece carrier 54 or its grippers 56, 58.

Once the workpiece carrier 54 has been lowered, as shown in FIG. 1, the housing 12 is displaced along the rails 24—to the right in FIG. 1, as indicated by arrow 97—until the grippers 56, 58 come into engagement with the hooks 62, 64.

Thereafter, the drive motor 84 is operated to cause the shaft 82 to move in clockwise direction—as viewed in FIG. 1. This leads to the chains 42, 44, 46 being reeled off by the pulleys 86, 88, 90, and as a result the workpiece carrier 54, together with the workpiece carrier frame 60 gripped thereon, are lifted into the chamber 14, as indicated by arrow 95 in FIG. 1. During this process, the loose pulley 92 will be pulled down by the counter-weight 96.

Once the workpiece carrier 54, together with the workpiece carrier frame 60, have been lifted to their fully raised position, the housing 12 is displaced along the rails 24, 25 in the direction indicated by arrow 99 in FIG. 1, until it reaches the position illustrated in FIG. 2 in which the housing 12 is positioned above the oil bath 35.

After closing the bottom 20 of the heating chamber 14 in gas-tight relationship, the heating chamber is initially flushed through using an inert gas until it is absolutely free from oxygen.

Figure 4:
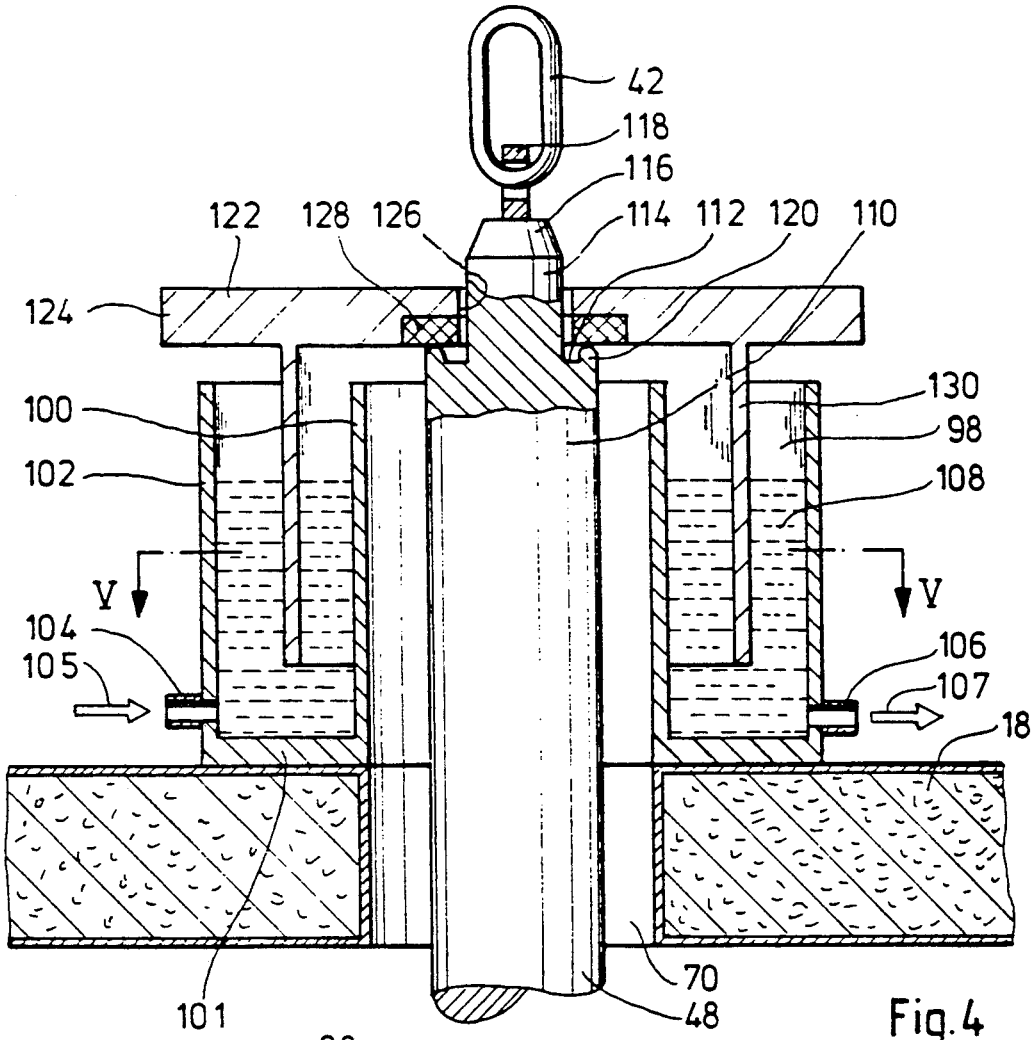
FIG. 4 shows the detail of the vertical-shaft furnace marked by a dash-dotted line in FIG. 2, in enlarged scale.
Figure 5:
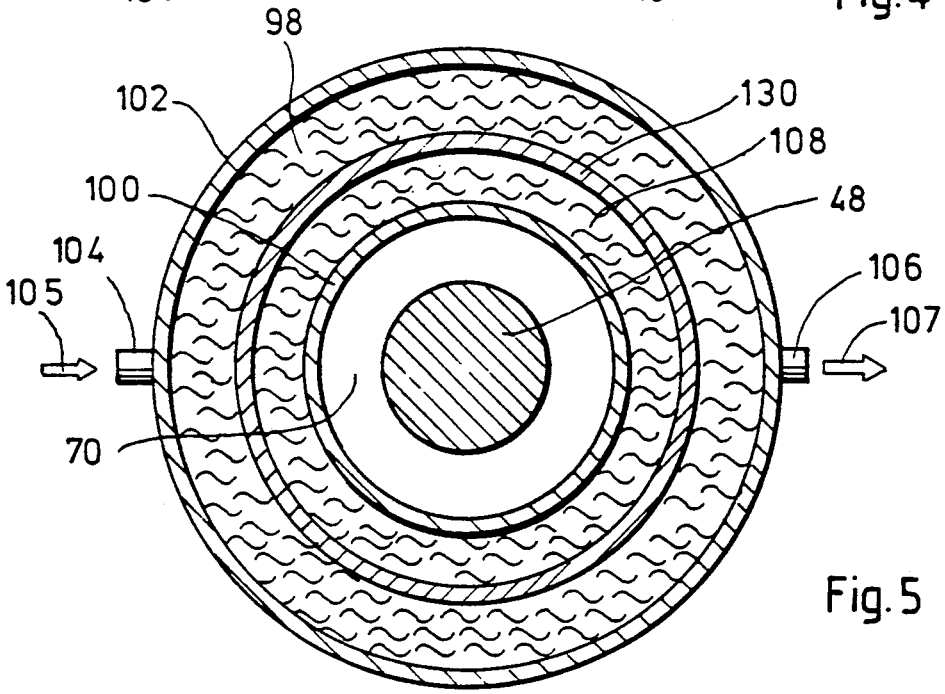
FIG. 5 shows a horizontal section along line V—V in FIG. 4.

The constructional measures illustrated in more detail in FIGS. 4 and 5 serve to prevent any inert gas from escaping through the openings 70, 72, 74 in the upper wall 18 of the housing 12. FIGS. 4 and 5 show a gas-tight design of the passage of the chain 42 through the opening 70.

The opening 70 is surrounded, on the upper face of the wall 18, by a double-walled vessel 98.

The vessel 98 comprises a first inner vertical cylindrical wall 100, which surrounds the opening 70, being substantially aligned with the latter in the vertical direction, as can be seen best in the cross-sectional view of FIG. 4.

A second outer cylindrical wall 102 arranged at a certain distance from the first inner wall 100 is connected to the latter at its lower end by a bottom 101.

The bottom 101 forms a gas-tight connection between the vessel 98 and the upside of the wall 18. The second outer wall 102 is provided, in the area of the bottom 101, with two diametrically opposite pipe connections 104, 106 which are connected to a recirculating and tempering system not shown in the drawing. The pipe connection 104 serves as inlet connection for the supply of liquid 108 into the annular space of the vessel 98, as indicated by arrow 105.

The pipe connection 106 serves as outlet connection through which the liquid 108 can be discharged from the vessel 98 and supplied to the recirculating system, as indicated by arrow 107. The recirculating system then returns the liquid into the system through the pipe connection 104.

The liquid consists of an oil.

In the raised position of the chain 42 illustrated in FIGS. 2 and 4, the rod 48 is located at the level of the openings 70.

The rod 70 is provided with a lower portion 110 carrying the gripper 56 at its lower end. The diameter of the area 110 is smaller than the diameter of the opening 70.

The section 110 is followed, via a shoulder 112, by a section 114 of smaller diameter.

The section 114 in its turn is followed, via a conical tapering portion 116, by a lug 118 on which the lowermost chain link of the chain 42 is fastened. Along the outer circumferential edge of the annular shoulder 112, one can seen an annular flange 120 projecting upwardly therefrom.

A sealing element 122 comprises a disk 124 which is provided with a central passage opening 26.

The diameter of the passage opening 26 is somewhat larger than the diameter of the section 114 of the rod 48, but smaller than the outer diameter of the section 110.

In addition, the diameter of the passage opening 126 is larger than the radius of the outer envelope of the chain 42, which means that the chain 42 can be passed through the passage opening 126 from above.

At the bottom of the disk 120, a gasket 128 surrounding the passage opening 126 is embedded in a matching annular groove which is not specifically described herein. The gasket 128 consists of a highly temperature-resistant graphite-based material.

The diameter of the disk 124 is a little larger than the outer diameter of the vessel 98.

A cylindrical wall 130 projecting from the bottom face of the disk 124 presents a length in the axial direction of the rod 48 which is somewhat shorter than the depth of the vessel 98.

The clear inner diameter of the cylindrical wall 130 is larger than the diameter of the first inner wall 100 by an amount equal to half the distance between the first inner wall 100 and the second outer wall 102. Consequently, the cylindrical wall 130 is immersed in the liquid 108 contained in the inner cavity of the vessel 98.

In the condition illustrated in FIGS. 2 and 4, the chain 42 and the rod 48 are raised to a position in which the annular flange 120 on the shoulder 112 is in contact with the bottom face of the gasket 128, whereby the passage opening 126 in the disk 124 of the sealing element 122 is closed gas-tight. In addition, the annular flange 120 has lifted the disk 124 a little off the upper edge of the vessel 98. The effect that the annular wall 130 is immersed in the liquid 108 guarantees a gas-tight seal against the outside. Of course, it must be ensured that the gas pressure inside the heating chamber 14 does not get as high as to urge the liquid 108 out of the tank 98. With the installation in this position, a heat-treating process may be carried out in the heating chamber 14 without any risk of gas escaping to the outside, or oxygen contained in the air penetrating into the heating chamber 14 from the outside. As the temperatures prevailing in the heating chamber may be as high as 1,000° Centigrade, the circulating and tempering system—which is not specifically shown in the drawings—serves the function to keep the oil contained in the vessel 98 at a temperature of, say, 200° Centigrade. The wall 130 being also immersed in the oil, the disk 124 of the sealing element 120 will likewise be cooled and the gasket 128 embedded therein as well, which contributes towards increasing the service life of the sealing element 122.

The drive motor 84 is controlled in such a manner as to ensure that the annular flange 120 is in engagement with the gasket 128.

Figure 7:
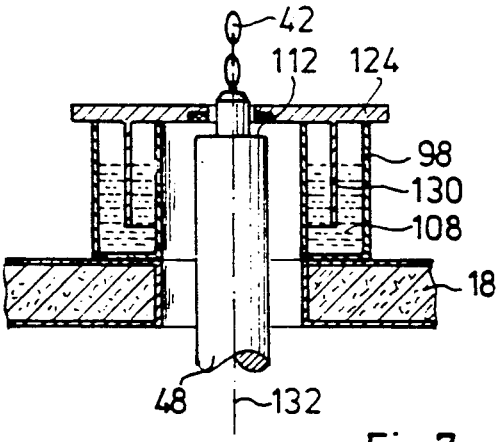
FIG. 7 shows a very simplified view, corresponding to the sectional view of FIG. 4, with the flexible element in a first, centered central position.

FIG. 7 shows a condition where the rod 48 has not yet been lifted to a position where it gets into engagement with the disk 124. In the condition illustrated in FIG. 7, the opening 26 is not yet sealed gas-tight, i.e. the rod 48 has to be raised a little further.

The design of the sealing arrangement for the opening 70 described above, in connection with FIGS. 4 and 5, is the same for the openings 72 and 74.

Once the workpiece carrier frame 60 has been lifted into the second upper position in the heating chamber 14, as illustrated in FIG. 2, and once the bottom 20 has been closed, the rods 48, 50, 52 are located in the openings 70, 72, 74 in such a way that their longitudinal center axes extend substantially coaxially to the longitudinal center axis of the respective opening.

Figure 6:
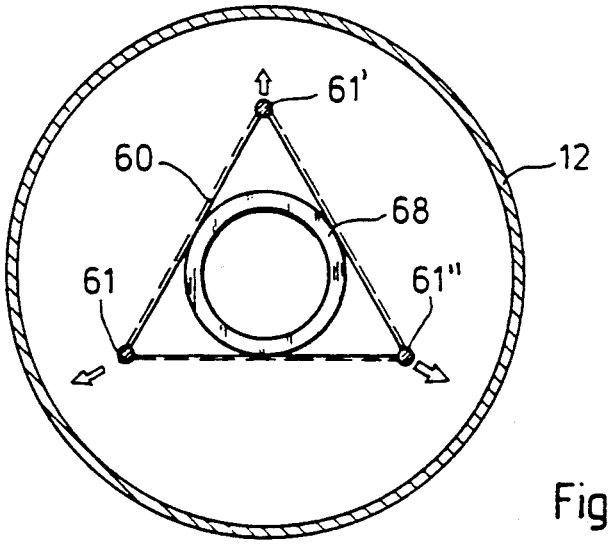
FIG. 6 shows a very diagrammatic section along line VI—VI in FIG. 2.

During heating-up of the heating chamber 14, the parts contained therein will start to expand. FIG. 6 illustrates the way in which the workpiece carrier frame, which exhibits a triangular cross-section, expands, the three lateral supports 61, 61', 61'' having the tendency to move away from the corners of the triangle, as indicated by the arrows in FIG. 6.

Consequently, the rods 48, 50, 52, whose longitudinal center axes 132 also coincide with the corners of an equilateral triangle, also tend to move away from the sides of the triangle so that the longitudinal center axis of the respective bar will move away from the longitudinal center axis of the respective opening.

Figure 8:
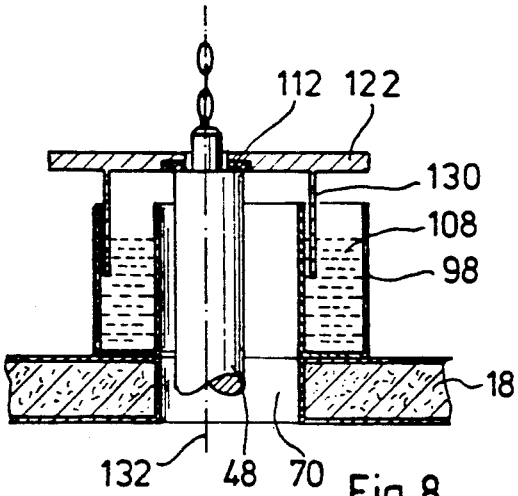
FIG. 8 shows a representation corresponding to that of FIG. 7, with the flexible element in a laterally offset position.

This situation is illustrated in FIG. 8 for the opening 70 and the rod 48.

A comparison with FIG. 7 reveals that due to the thermal expansion, the workpiece carrier 54 has moved a certain way to the left in the representation of FIG. 8, entraining on this way the sealing element 122 resting on the shoulder 112, and also wall 130 floating in the liquid 108. In spite of this relative movement between the rod 48 and the opening 70, the gas-tight seal to the outside remains intact, the seal of the sealing element 122 remaining in contact with the shoulder 112 and the wall 130 remaining immersed in the liquid 108. FIG. 8 shows, contrary to FIG. 4, that even if the rod 48 is raised somewhat further, as compared to FIG. 4, the gas-tight condition is still maintained so long as the wall 130 remains immersed in the liquid 108.

Figure 9:
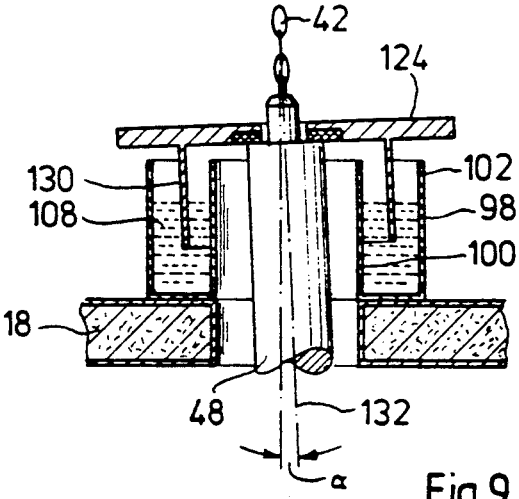
FIG. 9 shows a representation corresponding to that of FIG. 7, with the flexible element in a slightly tilted position.

FIG. 9 shows a situation where the rod 48 is tilted by an angle $\alpha$ relative to the vertical line. This situation may occur, for example, in the event a chain link of the chain 42 should come to lie awkwardly on the pulley 76. The design according to the invention ensures even under such condition that the gas-tight seal is maintained. Given the fact that the wall 130 may be received in the vessel 98 also in a slightly oblique position, without abutting against the walls 100, 102 of the vessel 98, the sealing element 122 will continue to remain in sealing contact with the shoulder 112.

Figure 10:
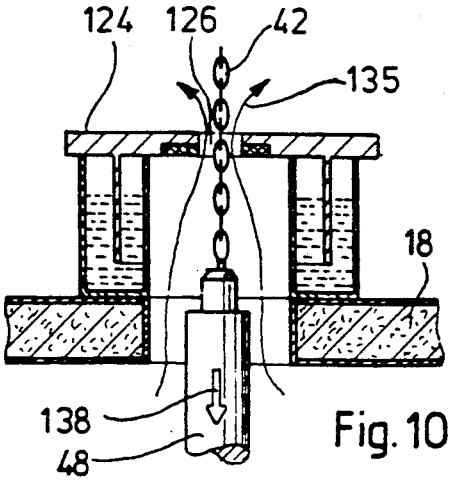
FIG. 10 shows a representation corresponding to that of FIG. 7, with the flexible element in a lowered position, relative to the representation of FIG. 7.

FIG. 10 illustrates the situation prevailing in the sealing chamber 14 after completion of the heat-treatment process, i.e. the rod is just being lowered from the second upper position into its first lower position, as indicated by arrow 133.

The disk 124 of the sealing element 122 is in contact with the upper face of the vessel 98, and the chain 42 may be passed through the passage opening 126 in the disk 124 at high speed.

In this operating condition, where the workpiece carrier 54, together with the workpiece carrier frame 60, are lowered at relatively high speed into the oil bath 35 for hardening, as indicated by arrow 133 in FIG. 2, it is no longer necessary to maintain a gas-tight seal on the opening 126 so that gas is permitted to escape from the interior of the heating chamber 14, as indicated by the flow arrows 135.

I claim:

1. A vertical shaft furnace for the heat treatment of metallic workpieces, comprising:

a furnace housing presenting a heating chamber closed at the top by a closed wall and having a lower end which can be opened and closed to permit the workpieces to be loaded into said heating chamber from below, said wall presenting an opening therein;

heating means for heating said heating chamber;

a workpiece carrier for carrying the workpieces into the heating chamber;

means for lifting the workpiece carrier from a first position below the heating chamber to a second position in the heating chamber to load a workpiece into the heating chamber, said lifting means including a flexible element suspending the workpiece carrier thereon and passing through said opening in the closed wall and drive means outside of the heating chamber for raising the flexible element to effect the second position of the workpiece carrier;

a bar member on said flexible element located to pass through said opening in the closed wall when said carrier is in the second position;

an open top vessel extending around said opening in the closed wall and containing a liquid;

a seal element against which said bar member is engaged in a gas-tight relationship in the second position of the carrier; and a projection extending from said seal element in a downward direction to generally surround said opening, said projection being immersed in the liquid in said vessel.

2. The furnace of claim 1, wherein said vessel includes an inside wall defining an opening registering with the opening in said closed wall and an outside wall extending around the inside wall to contain the liquid between the inside and outside walls.

3. The furnace of claim 2, wherein said bar member comprises a cylindrical rod smaller in diameter than said openings of the closed wall and vessel.

4. The furnace of claim 3, including:

a passage through said seal element; and a reduced diameter section of said rod extending through said passage in the second position of the carrier.

5. The furnace of claim 4, including a shoulder on said rod adjacent to said reduced diameter section, said shoulder effecting a gas-tight seal against the seal element in the second position of the carrier.

6. The furnace of claim 5, wherein said seal element and projection are movable up and down and laterally relative to the vessel, with said projection remaining immersed in the liquid as such movement occurs.

7. A vertical-shaft furnace for the heat treatment of metallic workpieces, comprising:

a furnace housing presenting a heating chamber closed at the top by a closed wall and having a lower end which can be opened and closed to permit the workpieces to be loaded into said heating chamber from below, said wall presenting an opening therein;

heating means for heating said heating chamber;

a workpiece carrier for carrying the workpieces into the heating chamber;

means for lifting the workpiece carrier from a first position below the heating chamber to a second position in the heating chamber to load a workpiece into the heating chamber, said lifting means including a flexible element suspending the workpiece carrier thereon and passing through said opening in the closed wall and drive means outside of the heating chamber for raising the flexible element to effect the second position of the workpiece carrier;

a rod portion of said flexible element located to pass through said opening in the closed wall when said carrier is in the second position;

a double wall vessel on said closed wall providing an annular chamber containing a liquid, said rod portion extending through said vessel in the second position of the carrier; and a seal element having an annular projection immersed in the liquid in said chamber, said rod portion engaging said seal element in a gas-tight relationship in the second position of the carrier.

8. The furnace of claim 7, wherein said vessel includes an inside wall defining an opening registering with the opening in said closed wall and an outside wall extending around the inside wall to contain the liquid between the inside and outside walls.

9. The furnace of claim 8, wherein said rod portion has a diameter smaller than said opening of the closed wall and vessel to allow lateral movement of said rod in said openings.

10. The furnace of claim 9, including:

a passage through said seal element; and a reduced diameter section of said rod portion extending through said passage in the second position of the carrier.

11. The furnace of claim 10, including a shoulder on said rod adjacent to said reduced diameter section, said shoulder effecting a gas-tight seal against the seal element in the second position of the carrier.

12. A vertical-shaft furnace for the heat treatment of metallic workpieces, comprising:

a furnace housing presenting a heating chamber closed at the top by a closed wall and having a lower end which can be opened and closed to permit the workpieces to be loaded into said heating chamber from below, said wall presenting an opening therein;

heating means for heating said heating chamber;

a workpiece carrier for carrying the workpieces into the heating chamber;

means for lifting the workpiece carrier from a first position below the heating chamber to a second position in the heating chamber to load a workpiece into the heating chamber, said lifting means including a flexible element suspending the workpiece carrier thereon and passing through said opening in the closed wall and drive means outside of the heating chamber for raising the flexible element to effect the second position of the workpiece carrier;

a rod portion of said flexible element having a main section located to pass through said opening in the closed wall when said carrier is in the second position and a reduced diameter section connected with the flexible element;

a double wall vessel on said closed wall having an inside wall presenting an opening therethrough registering with said opening in the closed wall and an outside wall cooperating with the inside wall to provide a chamber holding a liquid;

a seal element effecting a gas tight seal with said rod portion in the second position of the carrier, said seal element overlying said vessel and having a passage through which said reduced diameter section of the rod portion extends in the second position of the carrier; and a projection extending downwardly from said seal element into the liquid in said chamber.

13. A vertical-shaft furnace for the heat treatment of metallic workpieces, comprising:

a furnace housing presenting a heating chamber closed at the top by a closed wall and having a lower end which can be opened and closed to permit the workpieces to be loaded into said heating chamber from below, said wall presenting an opening therein;

heating means for heating said heating chamber;

a workpiece carrier for carrying the workpieces into the heating chamber;

means for lifting the workpiece carrier from a first position below the heating chamber to a second position in the heating chamber to load a workpiece into the heating chamber, said lifting means including a flexible element suspending the workpiece carrier thereon and passing through said opening in the closed wall and drive means outside of the heating chamber for raising the flexible element to effect the second position of the workpiece carrier;

a double wall vessel on said closed wall having an inside wall within which said flexible element extends and an outside wall extending around the inside wall and defining therewith a chamber containing a liquid;

a seal element overlying said vessel and presenting a passage through which said flexible element extends, said seal element having a projection extending around said inside wall and immersed in the liquid in said chamber; and means on said flexible element for effecting a gas-tight seal against the seal element to prevent gas leakage through said passage in the second position of the carrier.

* * * * *